United States Patent [19]

Guymer

[11] 4,132,438

[45] Jan. 2, 1979

[54] DEADLOCK LATCH

[75] Inventor: Barry R. Guymer, Potton Sandy, England

[73] Assignee: Schlegel (UK) Limited, Leeds, England

[21] Appl. No.: 769,910

[22] Filed: Feb. 18, 1977

[30] Foreign Application Priority Data

Mar. 28, 1976 [GB] United Kingdom ..... 7207/76

[51] Int. Cl.[2] ..... E05C 3/30

[52] U.S. Cl. ..... 292/111; 292/DIG. 26

[58] Field of Search ..... 292/DIG. 26, 66, 113, 292/106, 111

[56] References Cited

U.S. PATENT DOCUMENTS

| | | | |
|---|---|---|---|
| 1,922,062 | 8/1933 | Sullivan | 292/36 |
| 3,105,711 | 10/1963 | Woodworth et al. | 292/113 |
| 3,797,869 | 3/1974 | Shaw | 292/207 |

*Primary Examiner*—Richard E. Moore

*Attorney, Agent, or Firm*—Cumpston & Shaw

[57] ABSTRACT

A deadlock or latch comprising a body and a bolt member pivotally mounted on a first hub, pivotally mounted on the body remote from the pivoting axis of said first hub, said bolt member being resiliently biased so as to maintain its fully open and fully closing positions in abutment with stop means, and a second hub having a cam surface abutting one end of a slide member resiliently biased into abutment with said cam surface and arranged for sliding movement into and out of a locking position engaging a stop member on the first hub when the bolt member is in its fully closing position so as to prevent rotation of the first hub for movement of the bolt member out of its fully closing position.

7 Claims, 10 Drawing Figures

DEADLOCK LATCH

The present invention relates to locks and in particular to a deadlock or latch especially suitable for sliding doors.

The present invention provides a deadlock or latch comprising a body and a bolt member pivotally mounted on a first hub, pivotally mounted on the body, remote from the pivoting axis of said first hub, said bolt member being resiliently biased so as to maintain its fully open and fully closing positions in abutment with stop means, and a second hub having a cam surface abutting one end of a slide member resiliently biased into abutment with said cam surface and arranged for sliding movement into and out of a locking position engaging a stop member on the first hub when the bolt member is in its fully closing position so as to prevent rotation of the first hub for movement of the bolt member out of its fully closing position.

Advantageously the bolt member and first hub are arranged so that when it is struck in its fully closing position it is deflected into the lock body and most advantageously the second hub is provided with a second cam surface for engagement by the bolt member when it is deflected into the body so that the second hub is rotated to enable movement of the slide member out of its locking position.

The deadlock or latch of the present invention provides in a simple and economical design the combination of a conventional latch with a "deadlock" facility whereby a fully closing position of the bolt member may be locked so as to prevent opening of the latch by the latch operating system.

The present invention will now be described by way of example with reference to the accompanying drawings in which.

Figure 1:
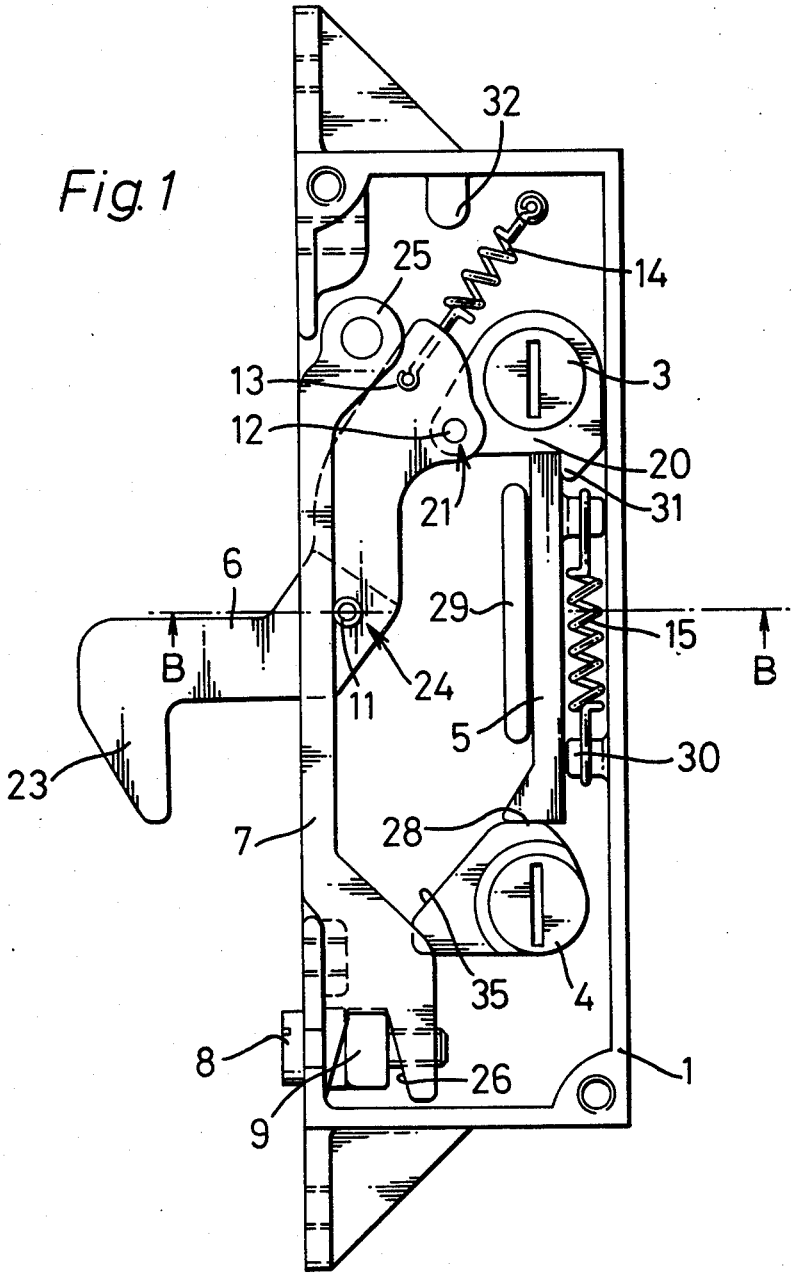
FIG. 1 is a plan view of the lock mechanism of a deadlock or latch.
Figure 2:
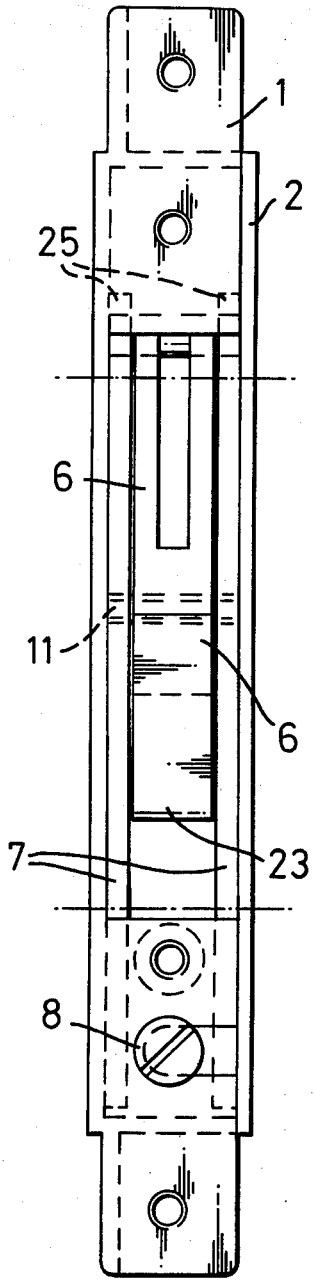
FIG. 2 is a side elevation of the lock of FIG. 1.
Figure 3:
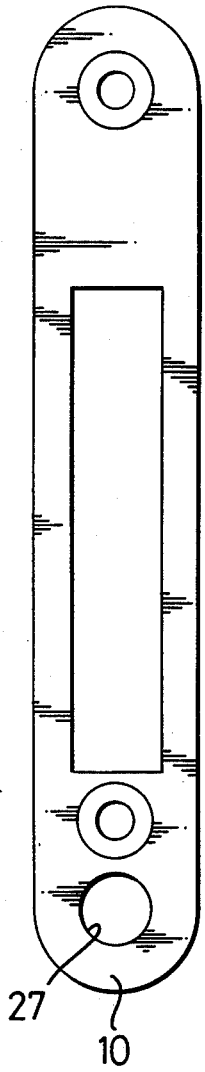
FIG. 3 is a plan view of a face plate for fitting over the side shown in FIG. 2.
Figure 4:
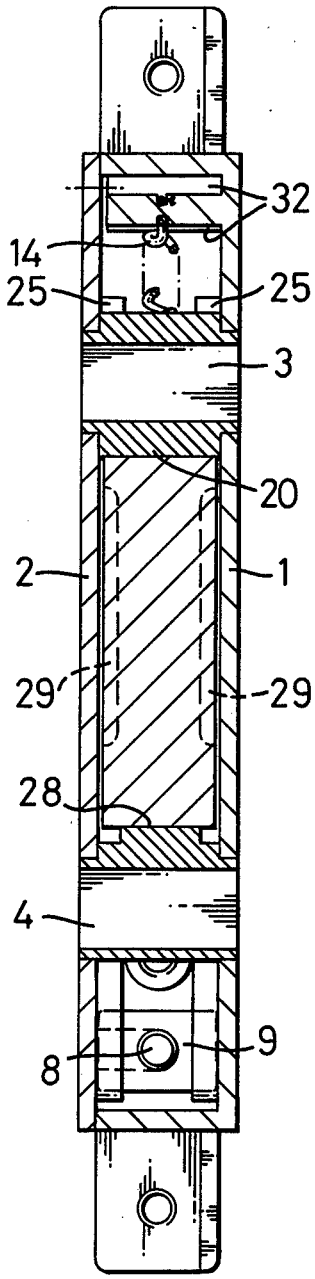
FIG. 4 is a sectional side elevation of the lock of FIGS. 1 to 3.

In FIGS. 1 and 2 is shown a lock comprising a body 1 and cover 2 (not shown in FIG. 1). A first hub 3 is pivotally mounted on the body 1 and has a hub plate 20 on which is pivotally mounted adjacent one end 21 a laminated generally "W" shaped bolt member 6 by means of a roll pin 12 spaced from the pivotal axis of the hub 3. One end of a helical spring 14 is attached to the bolt member 6 at 13, the other end of the spring 14 being attached to the body 1.

The other half of the bolt member 6 remote from the half at which it is attached to the first hub, comprises a bolt portion 23 for engaging a keeper (not shown). A roll pin 11 attached at 24 to the bolt member 6 abuts a retainer plate 7 acting as a stop for the roll pin when the bolt member 6 is in a fully closing position. The retainer plate 7 is pivotally mounted at one end 25 to the base 1 and at its other end is provided with a cut-out 26 for receiving a nut 9 located on a captive screw 8 whose head projects through an aperture 27 in a face plate 10 when this is attached to the body 1, so that rotation of the screw 8 results in pivotal movement of the retainer plate 7 thereby providing for adjustment of the fully closing position of the bolt member 6.

A second hub 4 pivotally mounted in the body 1 is provided with a cam surface 28 on which one end of a lock bar 5, which is slidably located between lugs 29,30 and is spring biased 15 towards the cam surface 28, bears. The other end of the lock bar 5 is disposed adjacent the hub plate 20 of the first hub 3 for movement into and out of the path of a stop 31 on the hub plate 20. The second hub 4 is also provided with a further cam surface 35 disposed for cooperation with the bolt portion 23.

The body 1 is also provided with a further lug 32 which acts as a stop for that part of the "W" shaped bolt member to which the spring 14 is attached.

In the bolt mechanism of FIGS. 7 to 10, the retainer plate 7 and its adjusting and mounting means are replaced by a plate 33 which has an aperture providing an internal cam surface 34 which acts as a guide and stop for the roll pin 11. In addition the cam surfaces 28 and 35 of the second hub 4 have a slightly different configuration.

Figure 7:
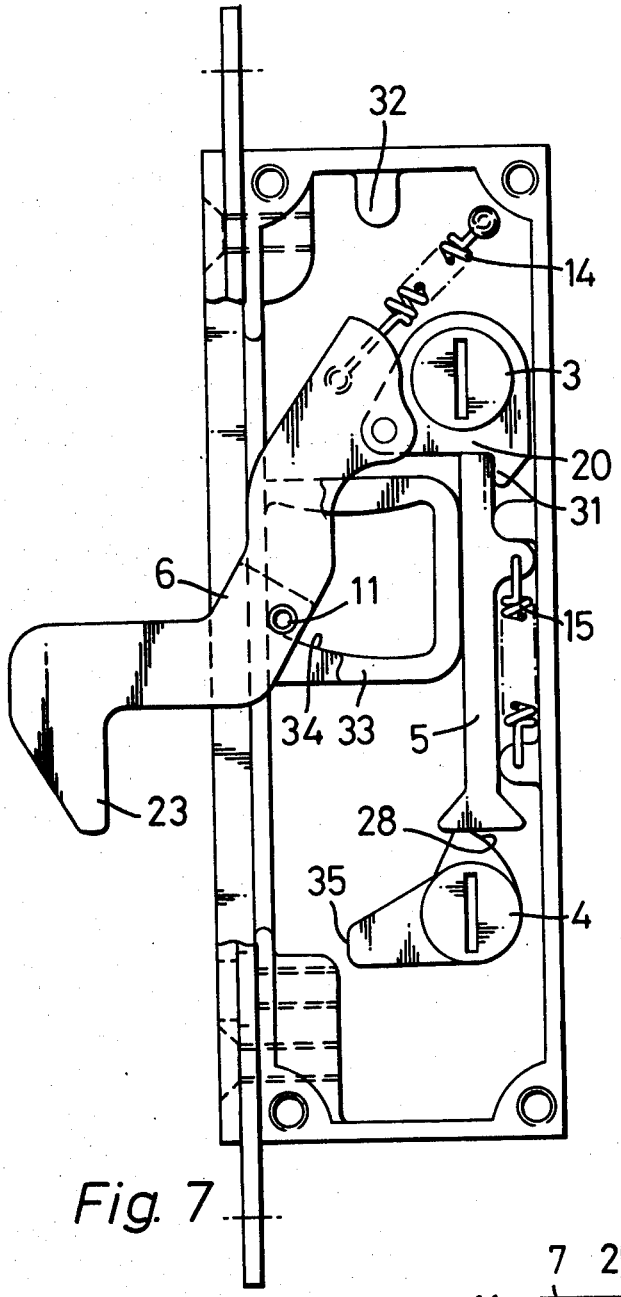
FIGS. 7 to 10 are partially incomplete views corresponding to that of FIG. 1 of a closely related lock mechanism showing the various operative positions of the bolt and bolt locking mechanism.
Figure 6:
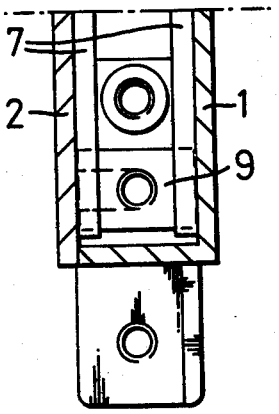
FIG. 6 is a partial sectional side elevation of the lock of FIGS. 1 to 5.
Figure 5:
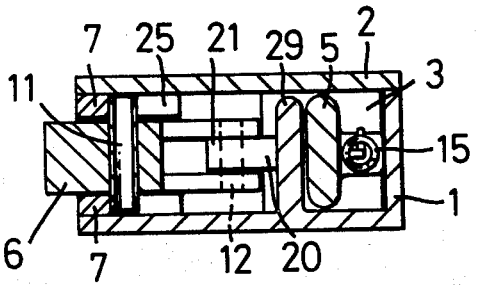
FIG. 5 is a transverse section of the lock of FIGS. 1 to 4 on the line B—B of FIG. 1.

FIG. 7 shows the bolt member 6 in its fully closing position with the second hub 4 in its locking position holding the lock bar 5 against the hub plate 20 and its stop 31 preventing rotation of the first hub 3 to move the bolt member 6 to its open position.

Figure 8:
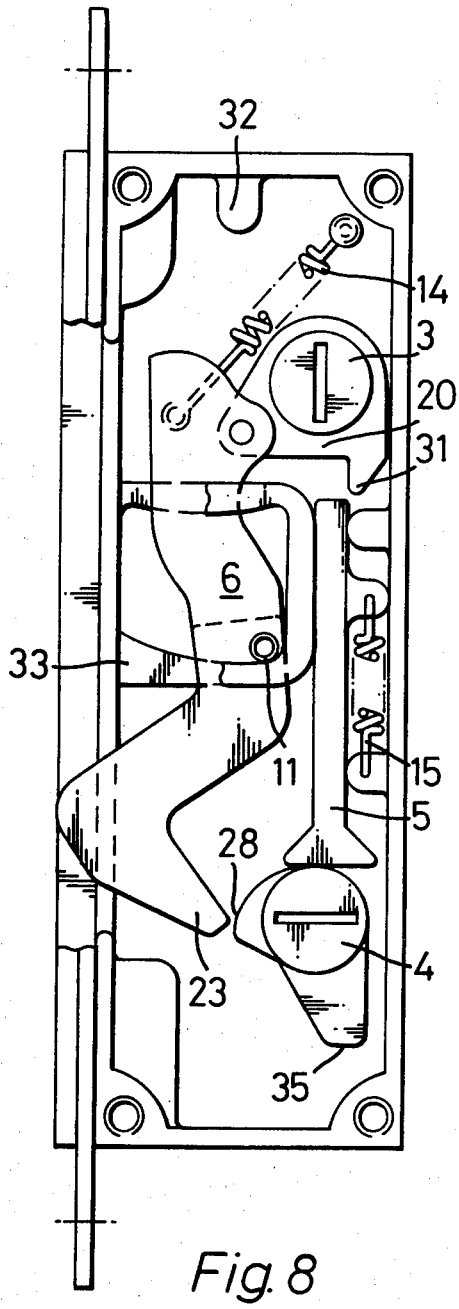

If an attempt were made to close a door with the lock mechanism in its locked fully closing position as shown in FIG. 7, then the bolt member 6 would be deflected into the position shown in FIG. 8 as the bolt portion 23 struck the keeper (not shown). As the bolt portion 23 moves into the position shown in FIG. 8, it engages the second cam surface 35 of the second hub 4 thereby rotating it and its first cam surface 28 so that the lock bar 5 is moved out of engagement with the hub plate 20 and its stop 31, thereby unlocking the mechanism.

Figure 9:
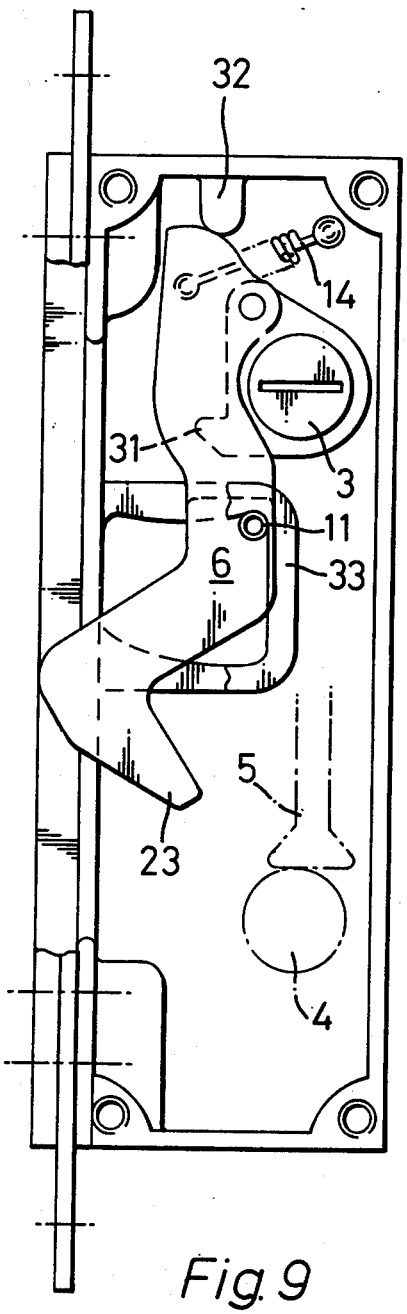

The bolt member 6 is now free to return under the influence of the spring 14 to its fully retracted open position in which it abuts the lug 32 as shown in FIG. 9.

Figure 10:
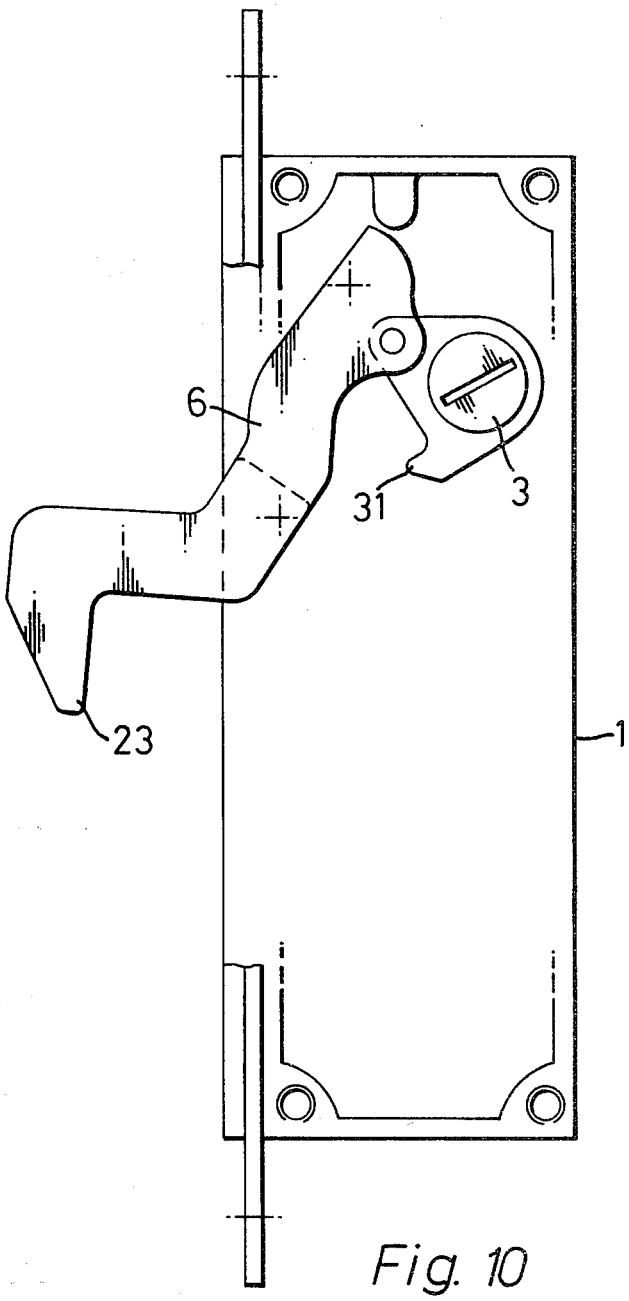

In order to move the bolt member 6 to its fully closing position from its open position the first hub 3 is rotated moving the bolt member 6 out of the body 1 against the force of the spring 14 through a partially closing position as shown in FIG. 10 and then into the fully closing position as shown in FIG. 7.

The above described deadlocks or latches of the present invention are mountable in a door in known manner and operated by means of handles mounted to drive the hubs in known manner.

What is claimed is:

1. A deadlock or latch comprising a body, a first hub, first hub pivotal mounting means for pivotally mounting said first hub on said body, a bolt member, bolt member pivotal mounting means for pivotally mounting said bolt member on said first hub, said first hub pivotal mounting means being disposed on the body remote from said bolt member pivotal mounting means, said deadlock or latch having stop means and said bolt member being biased by a first resilient means so as to maintain a fully open position and a fully closing position in abutment with said stop means, said first hub having a stop member and said deadlock or latch also having a rotatable second hub spaced from said first hub and having a first cam surface, and a slide member having one end biased by a second resilient means into abutment with said first cam surface and being arranged for sliding movement into and out of a locking position engaging said stop member on said first hub when said bolt member is in its fully closing position whereby rotation of said first hub for movement of said bolt member out of its fully closing position may be prevented, and actuating means on said second hub responsive to deflection of said bolt member from its fully closing position for rotating said second hub and first cam surface causing said slide member to move out of its locking position for releasing said first hub member.

2. The deadlock or latch of claim 1 wherein said bolt member and said first hub are arranged so that when said bolt member is in its fully closing position and is struck, it is deflected into said lock body, without damage to the dead lock or latch.

3. The deadlock or latch of claim 2 wherein said actuating means on said second hub comprises a second cam surface for engagement by said bolt member when it is deflected into the body so that the second hub is rotated to enable movement of the slide member out of its locking position.

4. The deadlock or latch of claim 3 wherein the bolt member is arranged so that when it is deflected into the lock body it initially adopts a partially retracted position from which partially retracted position it is urged into its fully retracted position by said first resilient biasing means.

5. The deadlock or latch of claim 4 wherein said stop means is provided on the body and the bolt member has a pin for abutment with said stop means when the bolt member is in its fully closing position.

6. The deadlock or latch of claim 5 wherein said stop means is positionally adjustable in the direction of projection of the bolt member when in its fully closing position so that the fully closing position of the bolt member may be adjusted.

7. The deadlock or latch of claim 6 wherein is provided a captive screw having a head disposed so as to be accessible from outside the lock body and a nut in screw threaded engagement with said screw, and said stop means comprises a retainer plate having one end pivotally mounted on the lock body and a second end remote from said one end provided with a recess for receiving said nut.

* * * * *